US005787999A

United States Patent [19]

Holte

[11] Patent Number: 5,787,999

[45] Date of Patent: Aug. 4, 1998

[54] DRILL BIT WITH SET OF UNDERREAMER ARMS

[76] Inventor: Ardis L. Holte, 181 Polk St., Eugene, Oreg. 97402

[21] Appl. No.: 674,123

[22] Filed: Jul. 1, 1996

[51] Int. Cl.[6] ..... F21B 10/66

[52] U.S. Cl. ..... 175/273; 175/286; 175/389

[58] Field of Search ..... 175/273, 389, 175/390, 407, 286, 292, 417

[56] References Cited

U.S. PATENT DOCUMENTS

| | | | |
|---|---|---|---|
| 3,365,010 | 1/1968 | Howell et al. | 175/286 |
| 4,770,259 | 9/1988 | Jansson | 175/292 X |
| 5,052,503 | 10/1991 | Löf | 175/389 |

*Primary Examiner*—William P. Neuder

*Attorney, Agent, or Firm*—Marger, Johnson, McCollom & Stolowitz, P.C.

[57] ABSTRACT

A drill bit assembly includes a driver adapted for attachment to a down hole pneumatic hammer. A pilot bit is coupled to the driver in a manner permitting rotational and axial movement between driver and pilot bit. A series of underreamer arms are disposed intermediate the driver and the pilot bit and engage a centrally disposed cam block on the pilot bit. Pivot pins of the underreamer arms are journaled in and move with the driver during partial rotation of the driver during arm deployment and retraction. Passageways in the driver and pilot bit direct compressed air to the working surface of the bit for discharging particles upwardly through channels in the bit and driver. Inclined surfaces on the underreaming arms cooperate with the lower end of a casing to contribute to arm retraction prior to removal of the assembly through the casing.

12 Claims, 4 Drawing Sheets

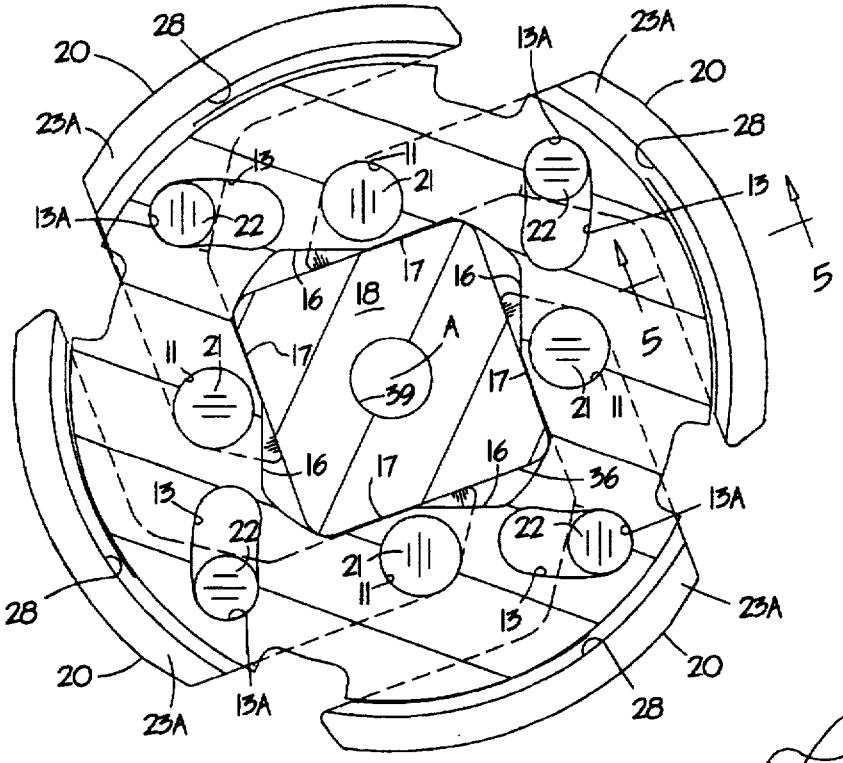
FIG. 3
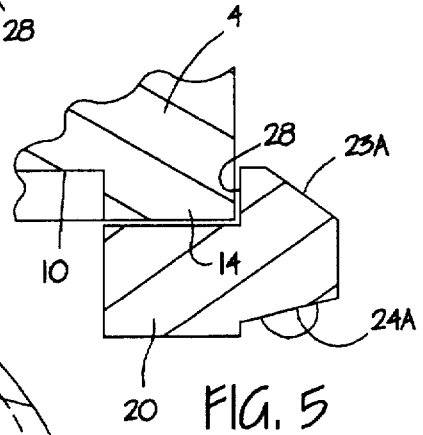
FIG. 5
FIG. 4
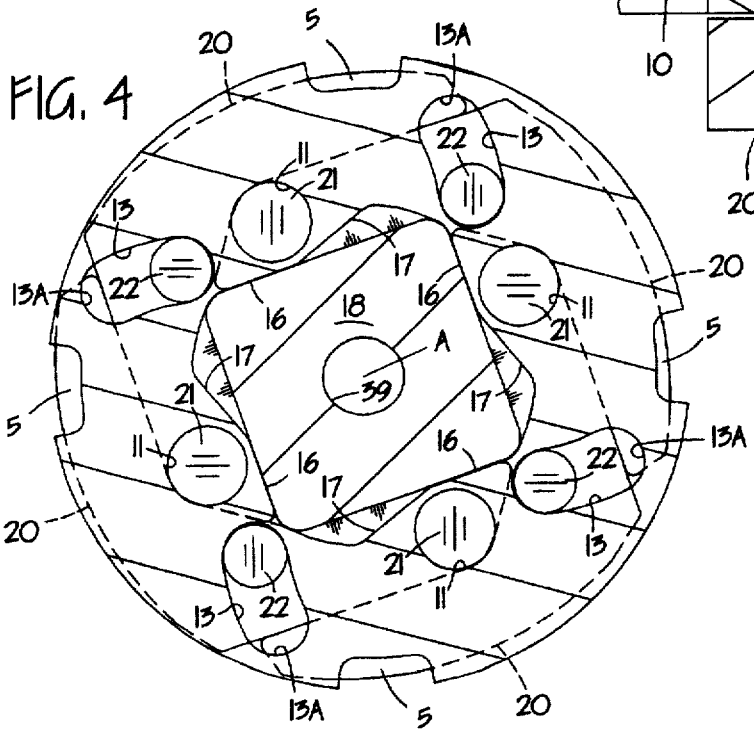

DRILL BIT WITH SET OF UNDERREAMER ARMS

BACKGROUND OF THE INVENTION

The present invention concerns drill bit construction for use where it is necessary to underream a radially enlarged area along a segment of a ground hole being drilled.

In the ground drilling art are devices termed underreamers, for the formation of radially enlarged areas extending about a pilot bit for reception of a casing or pipe. Eccentrically mounted underreamers are in use which include an arm which travels in an orbit for underreaming operation and retractable toward the hole axis for tool removal purposes. Eccentrically mounted underreamers incur the risk of the course of the hole being drilled being somewhat diverted upon the underreamer encountering severe and/or randomly located resistance, as for example, rock fragments, burried metal objects, etc. Any diversion of a large size drill bit is unacceptable in most drilling operations and particularly where a series of ground holes are being formed in a consecutive, closely spaced manner. The installation of casing in a drilled gorund hole is greatly hindered by any such diversion.

Known drilling equipment utilizes three bit mounted plates with a cumulative working surface of substantially less area than that of the bore being formed with the plates outwardly displaceable to perform underreaming. Such undersized plates are subject to excessive wear and result in slow drilling operations.

Underreaming in a ground hole can also be achieved by use of a crown or ring bit but a drawback to use of same is that components of the bit must be left in the underreamed area which is costly and otherwise unacceptable in some drilling operations.

SUMMARY OF THE PRESENT INVENTION

The present invention is embodied within a drill bit assembly equipped with a pilot bit and multiple, swingably displaceable arms for underreaming along a ground hole being drilled with subsequent retraction of the arms for removal through casing.

The present drill bit assembly includes a driver having a shank for attachment to a pneumatic percussive hammer of the type commonly used in drilling large ground holes. A pilot bit, below the driver, is pinned to the driver in a manner permitting rotational movement between the pilot bit and the driver. A cam on the pilot bit engages the underreaming arms for displacing same to a deployed position. Such camming of the underreaming arms is effected by partial rotation of the driver relative the cam on the pilot bit. Recessed areas of the driver define sockets and elongate openings within which are received arm pivot posts and arm limit stop pins. Further, during drilling, retainer pads about the bottom wall of the driver lock the arms in a deployed operating position.

Important objectives of the present invention include a drill bit assembly with a pilot bit and multiple arms for performing underreaming in a large diameter ground hole at a desired rate without leaving drilling or underreaming components in the ground; the provision of a drill bit assembly having underreamer arms displaceable and retractable by momentary changing the direction of rotation of a driver of the assembly; a drill bit assembly which provides a pilot bit with a full working surface for drilling in a rapid manner and having a set of underreaming arms which extend beyond and retract into the drill bit assembly to permit upward removal through a casing; the provision of a drill bit assembly including multiple, displaceable underreamer arms controlled by arcuate rotation of a driver component of the assembly relative a bit held against rotation by ground engagement and with a cam thereon which acts on the arms during driver rotation; the provision of a drill bit assembly with readily replaceable underreamer arms retractable into a space within the perimeter of the pilot bit.

BRIEF DESCRIPTION OF THE DRAWINGS

In the accompanying drawings:

FIGS. 3 and 4 are horizontal sectional views taken along line 3—3 of FIG. 1 and showing the lower portion of the driver receiving the underreaming arms with the arms shown extended and retracted;

FIG. 5 is a vertical sectional view taken along line 5—5 of FIG. 3 showing a fragment of the driver bottom wall and an arm locking pad thereon;

DETAILED DESCRIPTION OF THE PREFERRED EMBODIMENTS

Figure 1:
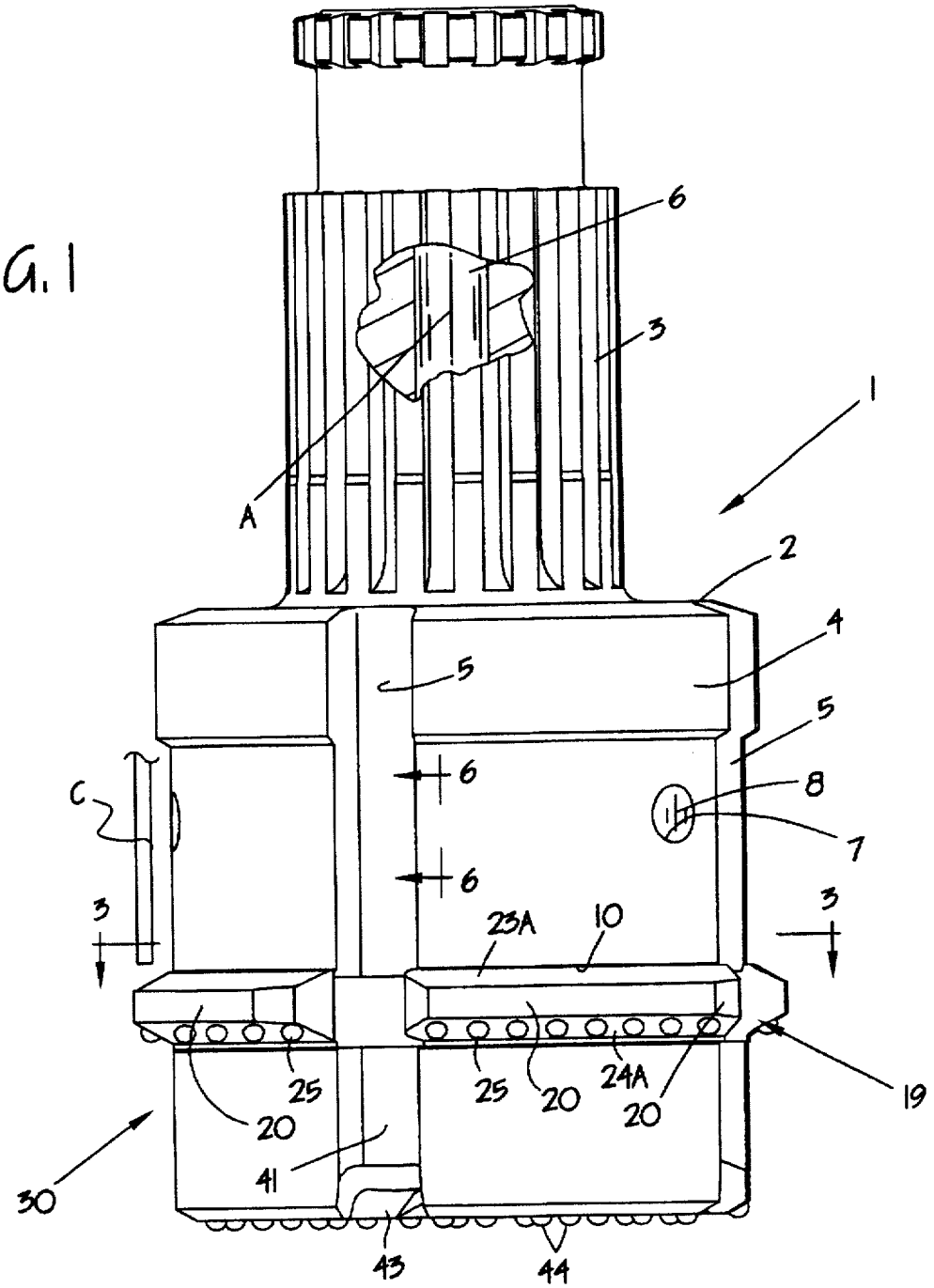
FIG. 1 is a side elevational view of the present drill bit assembly.

With continuing attention to the drawings, wherein applied reference numerals indicate parts similarly hereinafter identified, the reference numeral 1 indicates generally the present drill bit assembly for attachment to the lower end of a pneumatic down hole hammer of the type used in drilling large diameter ground holes two feet or so in diameter.

A driver at 2 includes a shank 3 of a diameter and splined for attachment to the percussive hammer. Integral with the shank is a driver head 4. About head 4 are circumferencially spaced channels 5 for upward passage of earthen particles or debris. An axially extending bore 6 of the driver receives a pressurized downward air flow for particle removal. Head 4 is cross bored off center at 7 to receive pin 8 engageable with a later described pilot bit of the drill assembly.

A lowermost surface 10 of the driver head 4 defines a series of cylindrical sockets 11 in FIG. 3 uniformly spaced apart and from vertical axis at A of the driver. Each socket has a companion elongage recess 13 formed in the lower portion of the driver to receive a limit stop pin of a later described underreamer arm. Additionally, lowermost surface 10 of head 4 is provided with multiple arm lock pads 14 in the form of downward projections which serve to lock each underreamer arm in an extended operative position. An internal wall of the driver includes segments 16 and 17 which define an open area which receives a cam block 18 and permits head movement thereabout. Irregular wall surfaces 16–17 alternately abut the cam block to limit driver rotation during arm positioning as later discussed.

Figure 2:
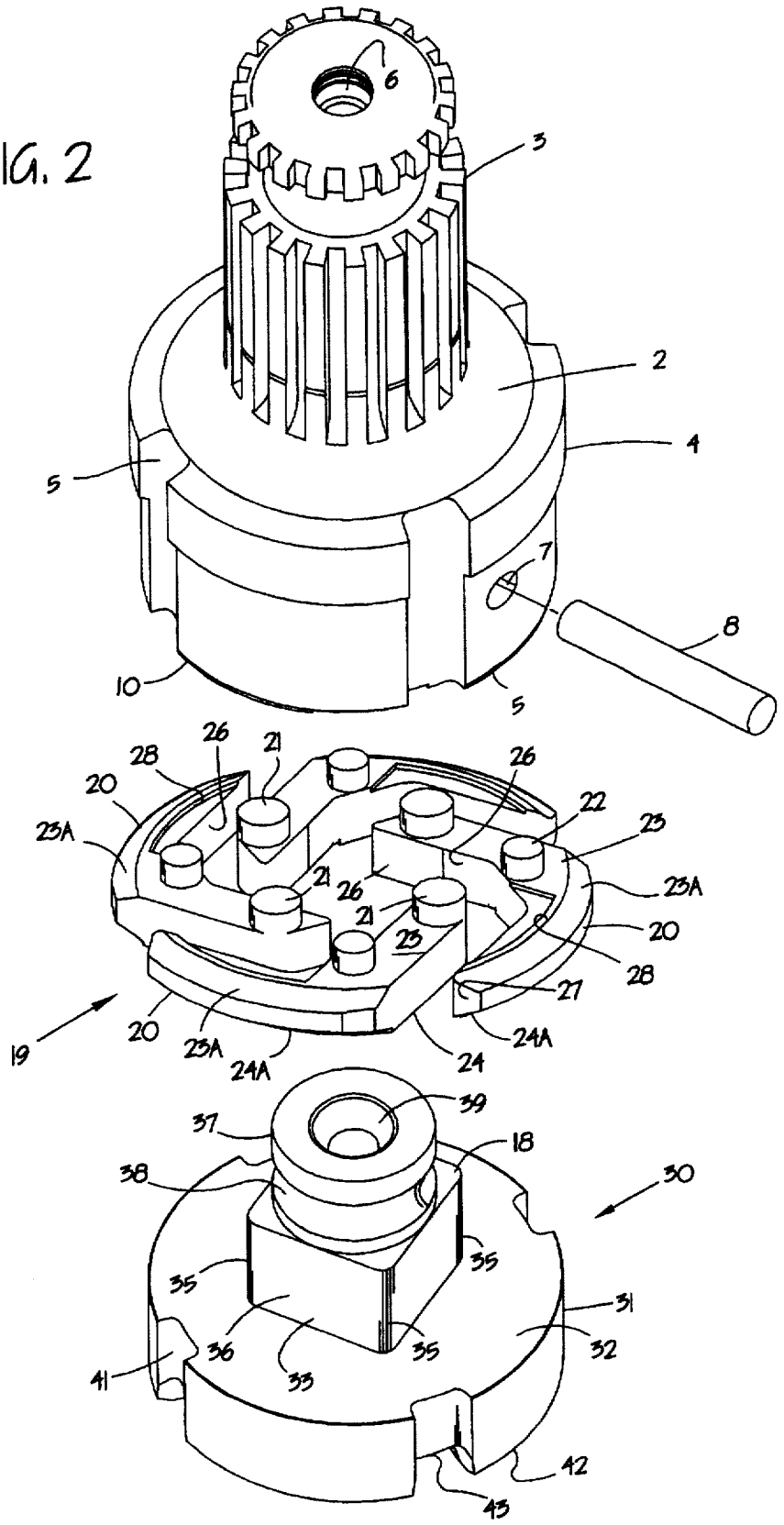
FIG. 2 is an exploded view of the drill bit assembly.
Figure 6:
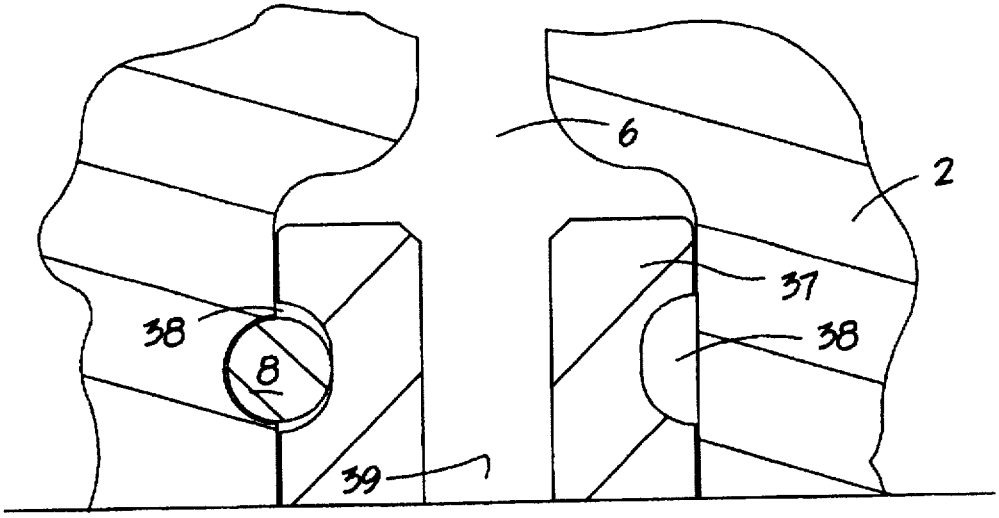
FIG. 6 is a vertical sectional view taken along line 6—6 of FIG. 1.
Figure 7:
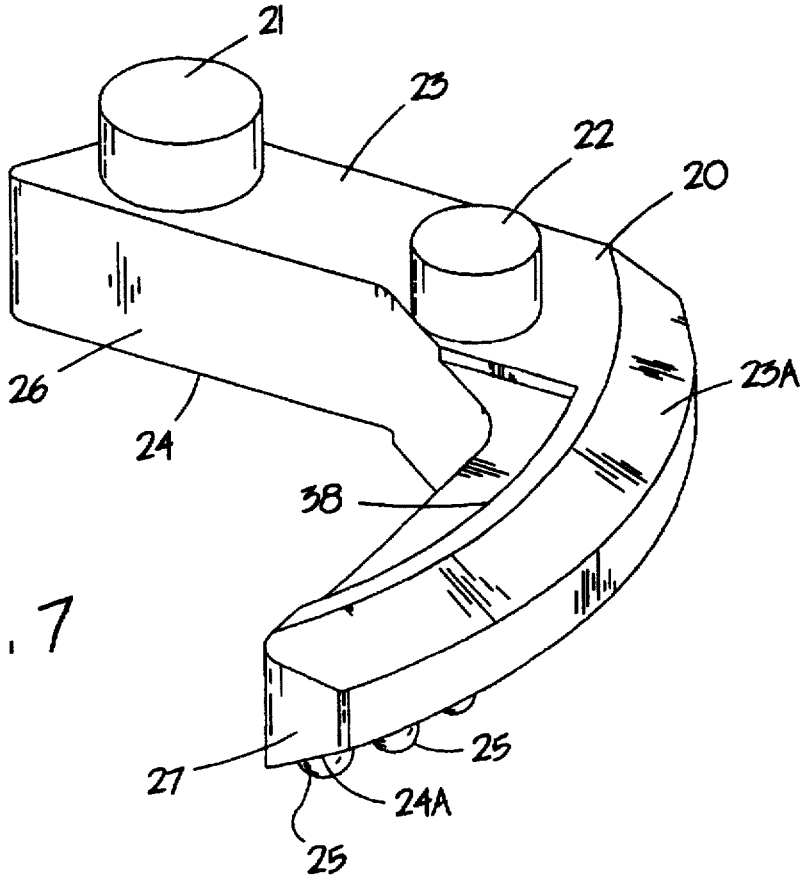
FIG. 7 is a perspective view of an underreamer arm.

A set of underreamer arms are indicated generally at 19 in FIG. 2 with the following description of one arm applicable to all of the arms at 20 which are generally of angular shape in plan view. With attention also to FIG. 7, an arm pivot post 21 seats in a socket 11 formed in the underside of head 4 of the driver. A limit stop post or pin 22 of the arm projects upwardly into an elongate recess 13 in the underside of driver head 4 with an end wall 13A of the recess limiting outward displacement of arm limit stop pin 22. Arm top and bottom walls are at 23–24 which both terminate outwardly in beveled arm outer edges 23A–24A, the lower beveled edge being provided with carbide inserts or buttons 25. An inner side wall 26 of an arm 20 moves about in relation to a later described cam block during arm deployment and retraction. A rearwardly beveled (relative arm rotation) arm end wall is at 27. Beveled arm edge 23A is engageable with the lower edge of a hole installed casing to contribute to inward arm movement during arm retraction at the end of a drilling operation. An arm shoulder at 28 cooperates with lock pads 14 on the driver when deployed. The inner side wall 26 of each arm 20 travels along a wall surface of the cam block during arm positioning.

A pilot bit is generally indicated at 30 and includes a main body 31 having an uppermost surface 32 on which is centrally located cam block 18 with walls 36. Integral with cam block 18 is a pedestal 37 having an annular groove 38 thereabout to receive head carried pin 8 in a tangential manner. Groove 30 is oversize to permit upward displacement of driver 2 during arm positioning and subsequent locking of the arms. A compressed air central passageway is at 39 of the bit and is in registration with driver air passageway 6. Spaced about the lower perimeter 31 of drill bit 30 are channels 41 through which debris flows upwardly past the arms during a drilling operation. A bottom wall 42 of the drill bit defines radially disposed air channels 43 which are served with compressed air flows via internal passageways served by axial passageway 39.

With continuing attention to the drill bit, the lowermost surface 42 thereof is suitably equipped with tungsten carbide buttons or other wear resistant members 44 commonly used in earth drilling equipment.

In a drilling and underreaming oepration pilot bit 30 advances into the ground with the underreamer arms locked in a deployed position below and radially beyond the advancing end of the casing at C. Casing movement is facilitated by the relatively large underreamed area. At completion of the operation, the driver is partially rotated in the direction opposite to drilling rotation to shift the arm pivot pins and specifically the arm inner ends along cam block walls 36 to retract each arm. Arm retraction is aided by the beveled arm outer edges 23A engaging the bottom edge of casing C during retraction at the end of a drilling operation to permit removal of the drill bit assembly through the casing.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. A drill bit assembly for attachment to a down hole pneumatic hammer, including, a driver, a pilot bit rotatably coupled to said driver;

a plurality of underreamer arms having peripheral drilling surfaces and movably mounted on the drill bit assembly, the underreamer arms operable between a first underreaming position wherein the peripheral drilling surfaces are concentrically disposed outside the pilot bit perimeter, and a second retracted position wherein the peripheral drilling surfaces are concentrically disposed inside the pilot bit perimeter; and first surfaces engageable with said underreamer arms and which urge the underreamer arms between said first and second positions responsive to rotational movement between said driver and said pilot bit.

2. The drill bit assembly claimed in claim 1 further comprising second surfaces engageable with said underreaming arms and which retain said arms in said first underreaming position.

3. The drill bit assembly claimed in claim 1 wherein each of said arms includes a pilot pin journaled in said driver and movable therewith in an arcuate manner about the vertical axis of the drill bit assembly and about said cam means for arm contact alternately at spaced apart points on said cam means for arm deployment and retraction occurring about the arm pivot pin.

4. The drill bit assembly claimed in claim 1 wherein said cam surfaces include multiple wall surfaces, each of said arms having a side wall opposite one of said wall surfaces and traversing same during rotational movement between the driver and said pilot bit.

5. The drill bit assembly claimed in claim 2 wherein said underreamer arms each have a shoulder for engagement with one of said second surfaces.

6. A drill bit assembly for a down hole percussive hammer and comprising, a driver;

a pilot bit rotatable coupled to said driver and having a pedestal including driving surfaces and cam surfaces;

a plurality of underreaming arms including pin means in engagement with the driver, said underreaming arms operable between a first concentric underreaming position and a second concentric retracted position responsive to relative rotation between said driver and said pilot bit:

each of said cam surfaces engageable with one of said underreaming arms responsive to rotational movement of the driver relative the pilot bit for urging said underreaming arms between said first and second concentric positions.

7. The drill bit assembly claimed in claim 6 wherein said driver includes a recess comprising said driving surfaces.

8. A drill bit assembly for a down hole percussive hammer and comprising, a driver, a pilot bit below said driver and having a pedestal and cam means, coupling means joining said pedestal to said driver and permitting relative movement between said driver and said drill bit, said coupling means providing relative movement between the driver and said drill bit along a vertical axis, said locks disengageable from the underreamer arms upon upward axial displacement of the driver;

underreaming arms interposed between the driver and said pilot bit and including pin means in engagement with the driver, the underreamer arms each have a shoulder for engagement with one of said locks, and said cam means having wall surfaces each of which engaged by one of said underreaming arms, said wall surfaces constraining said arms for travel along said wall surfaces during rotational movement of the driver relative the pilot bit for extension and retraction of said arms to and from underreaming positions.

9. The drill bit assembly claimed in claim 8 wherein said pedestal includes locking surfaces engageable with said underreamer arms and which lock said underreamer arms in said first concentric underreaming position.

10. A drill bit assembly for attachment to a down hole pneumatic hammer, including, a driver;

a pilot bit, coupling means coupling said driver and the pilot bit in a manner permitting rotational movement therebetween about a vertical axis of the drill bit assembly;

underreamer arms disposed intermediate the driver and the pilot bit and including underreaming surfaces positionable outside the pilot bit perimeter;

cam means including surfaces acting on said underreamer arms to constrain same for deployment into an underreaming position and for retraction therefrom during rotational movement between said driver and said pilot bit;

locking means carried by said driver for arm engagement and locking said arms in said underreaming position, and;

each of said arms including a pilot pin journaled in said driver and movable therewith in an arcuate manner about the vertical axis of the drill bit assembly and about said cam means for arm contact alternately at spaced apart points on said cam means for arm deployment and retraction occurring about the arm pivot pin.

11. The drill bit assembly claimed in claim 10 wherein said underreamer arms additionally include limit stop pins for travel in elongate recesses in the driver.

12. The drill bit assembly claimed in claim 10 wherein said cam means has multiple wall surfaces, each of said arms having a side wall opposite one of said wall surfaces and traversing same during rotational movement between the driver and said pilot bit.

* * * * *